US006309022B1

(12) United States Patent
Melgarejo et al.

(10) Patent No.: US 6,309,022 B1
(45) Date of Patent: Oct. 30, 2001

(54) PELVIC STABILIZER MECHANISM FOR A WHEELCHAIR

(75) Inventors: Mauricio Melgarejo; Alejandro Melgarejo, both of Simi Valley, CA (US)

(73) Assignee: Freedom Designs Incorporated, Simi Valley, CA (US)

( * ) Notice: Subject to any disclaimer, the term of this patent is extended or adjusted under 35 U.S.C. 154(b) by 0 days.

(21) Appl. No.: 09/552,362

(22) Filed: Apr. 19, 2000

Related U.S. Application Data

(60) Provisional application No. 60/130,046, filed on Apr. 19, 1999, and provisional application No. 60/129,978, filed on Apr. 19, 1999.

(51) Int. Cl.[7] ..... A62B 35/00

(52) U.S. Cl. ..... 297/467; 297/488

(58) Field of Search ..... 297/256.15, 423.26, 297/423.3, 467, 487, 488, DIG. 4; 403/322.4, 324

(56) References Cited

U.S. PATENT DOCUMENTS

| | | | | |
|---|---|---|---|---|
| 2,784,775 | | 3/1957 | Madsen . | |
| 3,216,738 | | 11/1965 | Bockus . | |
| 3,992,057 | | 11/1976 | Studebaker . | |
| 4,021,126 | * | 5/1977 | Deeter et al. | 403/322.4 X |
| 4,192,546 | | 3/1980 | Smith . | |
| 4,813,746 | * | 3/1989 | Mulholland | 247/488 |
| 4,880,277 | | 11/1989 | Takahashi et al. . | |
| 5,320,416 | | 6/1994 | Kornberg . | |
| 5,372,405 | | 12/1994 | Cash et al. . | |
| 5,447,356 | * | 9/1995 | Snijders | 297/487 X |
| 5,551,107 | | 9/1996 | Graebe . | |
| 5,593,244 | * | 1/1997 | Ruckert | 403/322.4 |
| 5,613,738 | | 3/1997 | Britton . | |
| 5,636,900 | | 6/1997 | Wilkie et al. . | |
| 5,758,926 | | 6/1998 | Wilkie et al. . | |

OTHER PUBLICATIONS

Adaptive Engineering Lab, 1999 Catalog, pp. 51–54, 1999.*

* cited by examiner

*Primary Examiner*—Peter R. Brown

(57) ABSTRACT

A pelvic support mechanism for a wheelchair seat has a bracket comprising a generally "L"-shaped, pivoting portion and a stationary portion that is hingedly attached to the "L"-shaped portion. The pelvic support mechanism has a padded pelvic support mounted on said "L"-shaped, pivoting portion, the stationary portion being mounted onto the wheelchair seat. A release lever that is pivotally mounted on said "L"-shaped portion of the bracket. A sliding bolt that is mounted within the "L"-shaped portion of the bracket and which is interconnected with the release lever. A compression spring that is mounted in the "L"-shaped portion of the bracket and that is in contact with the sliding bolt. An opening in the stationary portion of the bracket for receiving the sliding bolt. Wherein the releasable pelvic mechanism has a locked mode in which the sliding bolt is engaged with the opening in the pivoting portion of the bracket, thereby preventing the pelvic support from pivoting, and an unlocked mode in which the sliding bolt is not engaged with the opening in the pivoting portion of the bracket, thereby permitting the pelvic support to pivot.

4 Claims, 8 Drawing Sheets

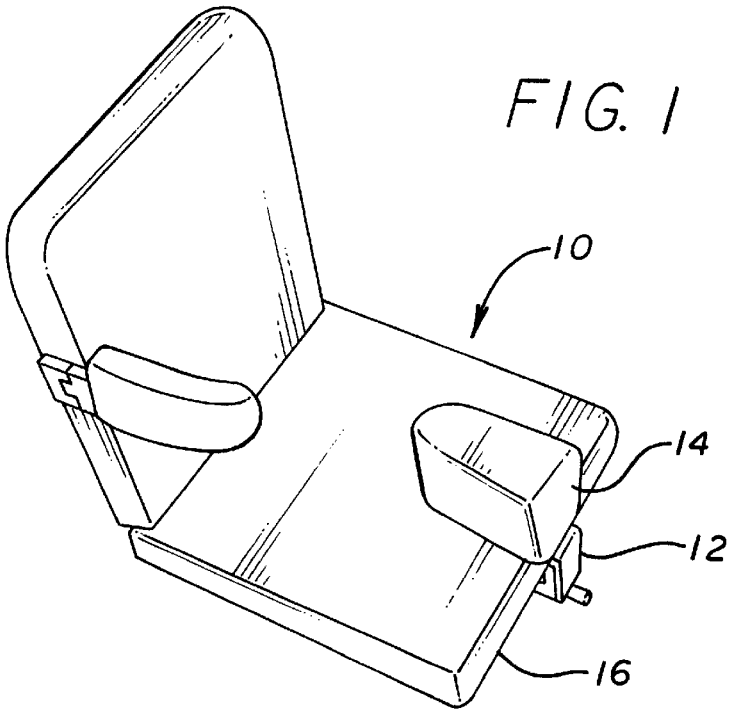
FIG. 1
FIG. 2
PRIOR ART
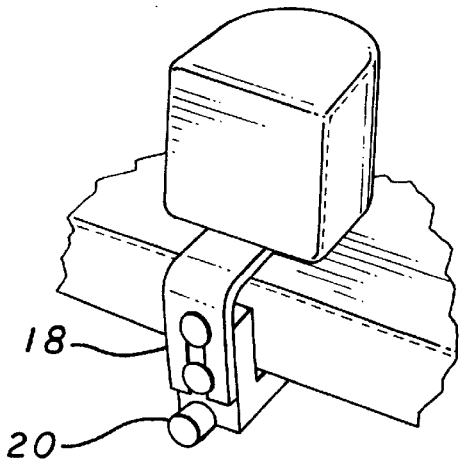

PELVIC STABILIZER MECHANISM FOR A WHEELCHAIR

I. RELATED APPLICATIONS

The present application relates to two previously-filed U.S. provisional patent applications, Serial Nos. 60/130,046 and 60/129,978, which were filed on Apr. 19, 1999 and which are incorporated by reference herein. The present application also relates to a patent application entitled, "Hinge Mechanism For A Trunk Support Apparatus," which is being filed concurrently herewith and is also incorporated by reference.

II. BACKGROUND

A. Field of The Invention

The present invention relates to locking hinge mechanisms and, in particular, to an improved pelvic stabilizer mechanism for a wheelchair.

B. Prior Art

Pelvic stabilizer mechanisms are used to retain a patient's pelvis and lap area in place in a wheelchair. In particular, the pelvic stabilizer mechanism prevents the patient from sliding forward out of the wheelchair. FIG. 1 illustrates a pelvic stabilizer mechanism 12 according to one embodiment of the present invention, which will be described in more detail below. The pelvic stabilizer mechanism 12 has a padded portion 14 which, when the mechanism is in the locked upright position of FIG. 1, extends from the edge of the seat 16 toward the pelvis of the seated patient.

FIGS. 2–4 illustrate a prior art pelvic stabilizer mechanism 18. To disengage the mechanism 18 from the locked upright position of FIG. 2, the user pushes a disengage button 20 (FIG. 3), which unlocks the mechanism and allows the user to rotate it forward (FIG. 4) and downwardly. A difficulty with this arrangement is that some patients have trouble disengaging the pelvic support mechanism by themselves. The release button 20 is hard to push and, if it is not pushed just right, it will not release.

III. SUMMARY OF THE INVENTION

The present invention relates to conveniently securing a patient into a wheelchair. Releasable mechanisms are provided which allow an attendant to easily lock a patient into place or, as the case may be, to disengage the mechanisms for removing or repositioning the patient within the wheelchair.

According to one embodiment of the invention having both a releasable side support and a releasable pelvic support, a system for securing a patient within a wheelchair has a wheelchair seat. A trunk support mechanism is mounted to the wheelchair seat and has a front bracket and a hinge piece extending from the back bracket toward the front bracket. The hinge piece has a top and a bottom, the bottom including an elongated open channel defined by first and second walls. A locking member is rotatably mounted on the front bracket, the locking member having a lever and an elongated locking head that is configured to fit within the open channel of the hinge piece. The lever extends downwardly from the front bracket, the locking head extending forwardly. The locking mechanism has a first, locked mode in which the locking head is situated within the open channel and in between said first and second walls, and a second, unlocked mode in which the locking head is situated outside of the open channel. The locking mechanism has a compression spring mounted within the hinge piece and adjacent to the locking member, to maintain said locking head in said open channel when the locking mechanism is in the first, locked mode.

Continuing with additional features of the same embodiment, a releasable pelvic support mechanism mounted to said wheelchair seat has a bracket comprising a generally "L"-shaped, pivoting portion and a stationary portion that is hingedly attached to said "L"-shaped portion. The pelvic support mechanism has a padded pelvic support mounted on the "L"-shaped, pivoting portion. The stationary portion is mounted onto the wheelchair seat. The support mechanism also has a release lever that is pivotally mounted on said "L"-shaped portion of said bracket. A sliding bolt is mounted within said "L"-shaped portion of said bracket and is interconnected with the release lever. A compression spring is mounted in the "L"-shaped portion of said bracket and is in contact with the sliding bolt. There is an opening in the stationary portion of said bracket for receiving the sliding bolt. The releasable pelvic mechanism has a locked mode in which the sliding bolt is engaged with the opening in the pivoting portion of the bracket, thereby preventing the pelvic support from pivoting, and an unlocked mode in which the sliding bolt is not engaged with the opening in the pivoting portion of the bracket, thereby permitting the pelvic support to pivot.

Considering another particular embodiment, a pelvic support mechanism for a wheelchair seat has a bracket comprising a generally "L"-shaped, pivoting portion and a stationary portion that is hingedly attached to the "L"-shaped portion. The pelvic support mechanism has a padded pelvic support mounted on said "L"-shaped, pivoting portion, the stationary portion being mounted onto the wheelchair seat. A release lever that is pivotally mounted on said "L"-shaped portion of the bracket. A sliding bolt that is mounted within the "L"-shaped portion of the bracket and which is interconnected with the release lever. A compression spring that is mounted in the "L"-shaped portion of the bracket and that is in contact with the sliding bolt. An opening in the stationary portion of the bracket for receiving the sliding bolt. Wherein the releasable pelvic mechanism has a locked mode in which the sliding bolt is engaged with the opening in the pivoting portion of the bracket, thereby preventing the pelvic support from pivoting, and an unlocked mode in which the sliding bolt is not engaged with the opening in the pivoting portion of the bracket, thereby permitting the pelvic support to pivot.

Various other objects and features of the invention will become apparent in the Detailed Description below, in the drawings and in the claims.

IV. BRIEF DESCRIPTION OF THE DRAWINGS

FIG. 1 is a perspective view of a prototype wheelchair seat that incorporates a pelvic support mechanism according to the present invention;

FIG. 2 is a front perspective view of a wheelchair having a prior art pelvic support mechanism that is in the upright, locked position;

V. DETAILED DESCRIPTION OF A PREFERRED EMBODIMENT

FIG. 1 is a perspective view of a prototype wheelchair seat 10 that incorporates a pelvic support mechanism 12 according to the present invention.

Figure 5:
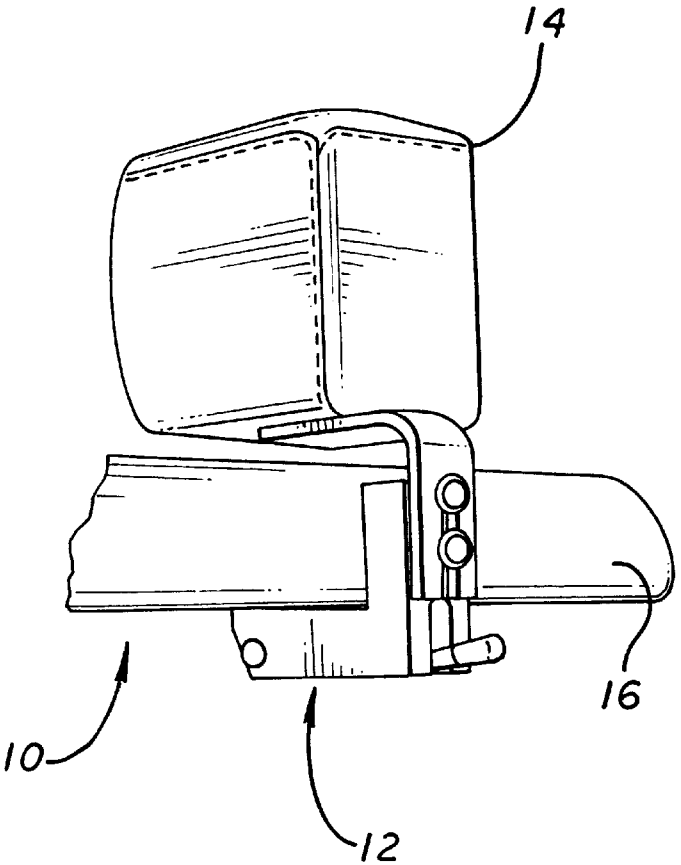
FIG. 5 is a front perspective view from below of an improved pelvic support mechanism mounted onto a wheelchair seat.

FIG. 5 is a front perspective view from below of an improved pelvic support mechanism 12 mounted onto a wheelchair seat 10.

Figure 3:
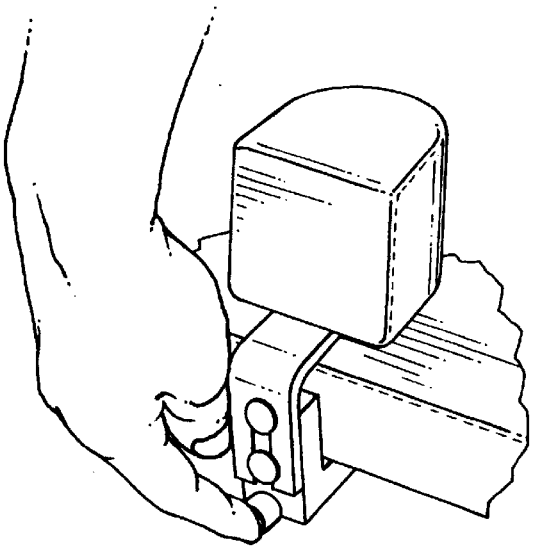
FIG. 3 PRIOR ART
FIG. 3 is a front perspective view of a user pushing the disengage button of the pelvic support mechanism of FIG. 2.
Figure 4:
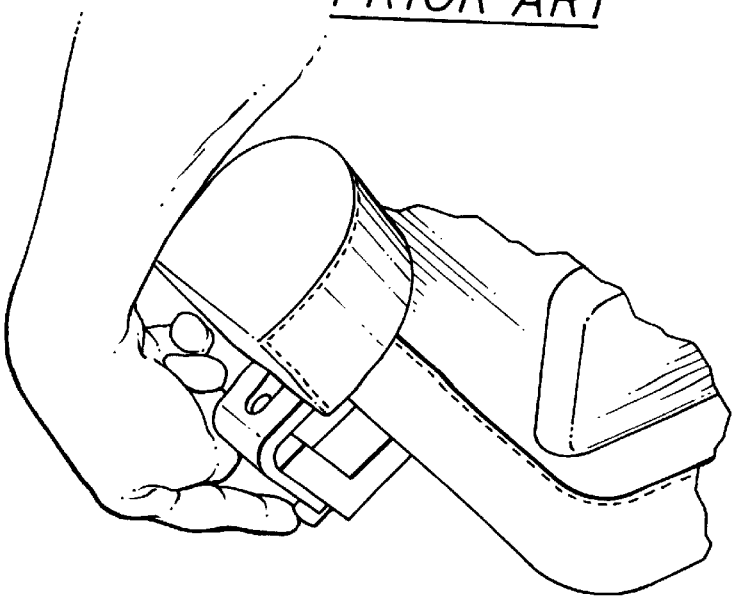
FIG. 4 PRIOR ART
FIG. 4 is a front perspective view of a the pelvic support mechanism of FIG. 3 being rotated forward and downwardly away from the wheelchair seat.
Figure 6:
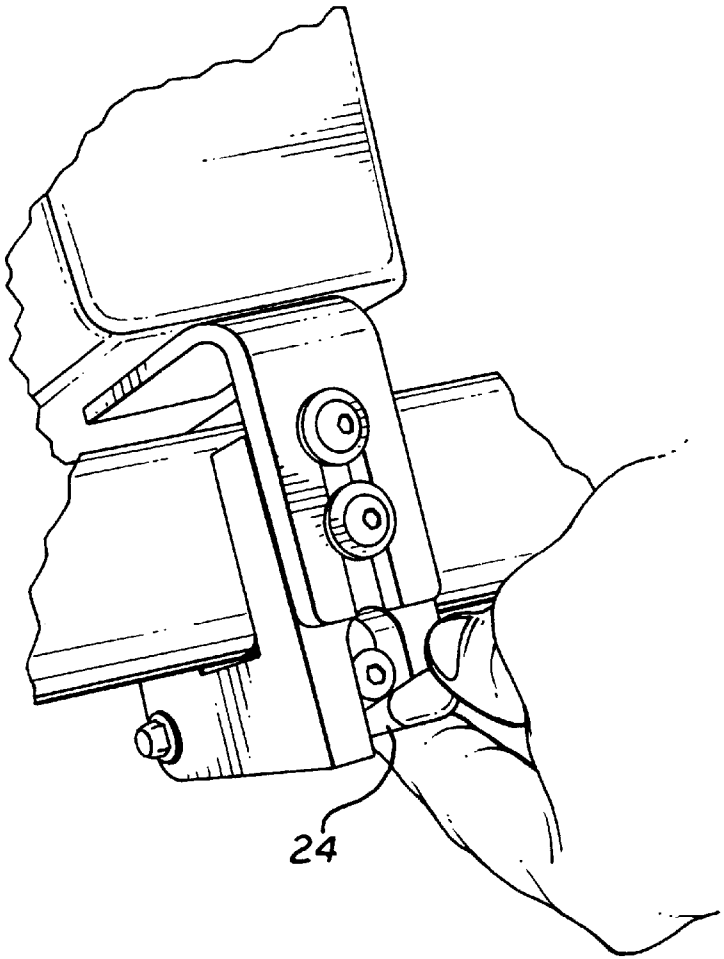
FIG. 6 is a detail view of the pelvic support mechanism of FIG. 5 in which a user is grasping the disengage lever and begins to move the lever downwardly.

FIG. 6 is a detail view of the pelvic support mechanism 12 in which a user is grasping the disengage lever 24 and begins to move the lever downwardly.

Figure 7:
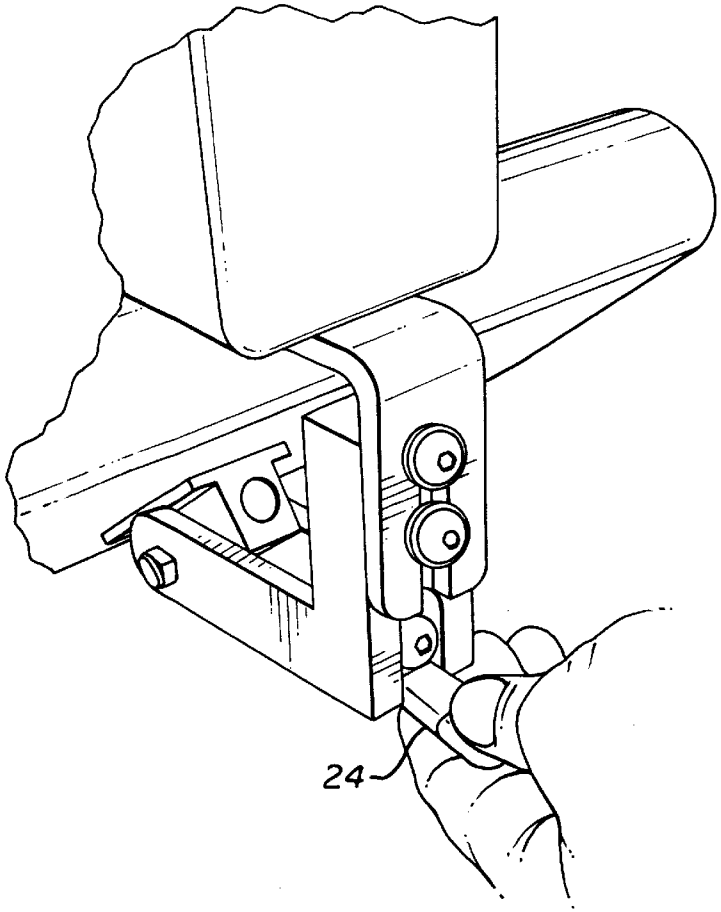
FIG. 7 is a detail view similar to FIG. 6 in which the user has pushed the disengage lever downwardly and has begun rotating the pelvic support down and forward.

FIG. 7 is a detail view similar to FIG. 6 in which the user has pushed the disengage lever downwardly 24 and has begun rotating the pelvic support pad 26 down and forward.

Figure 8:
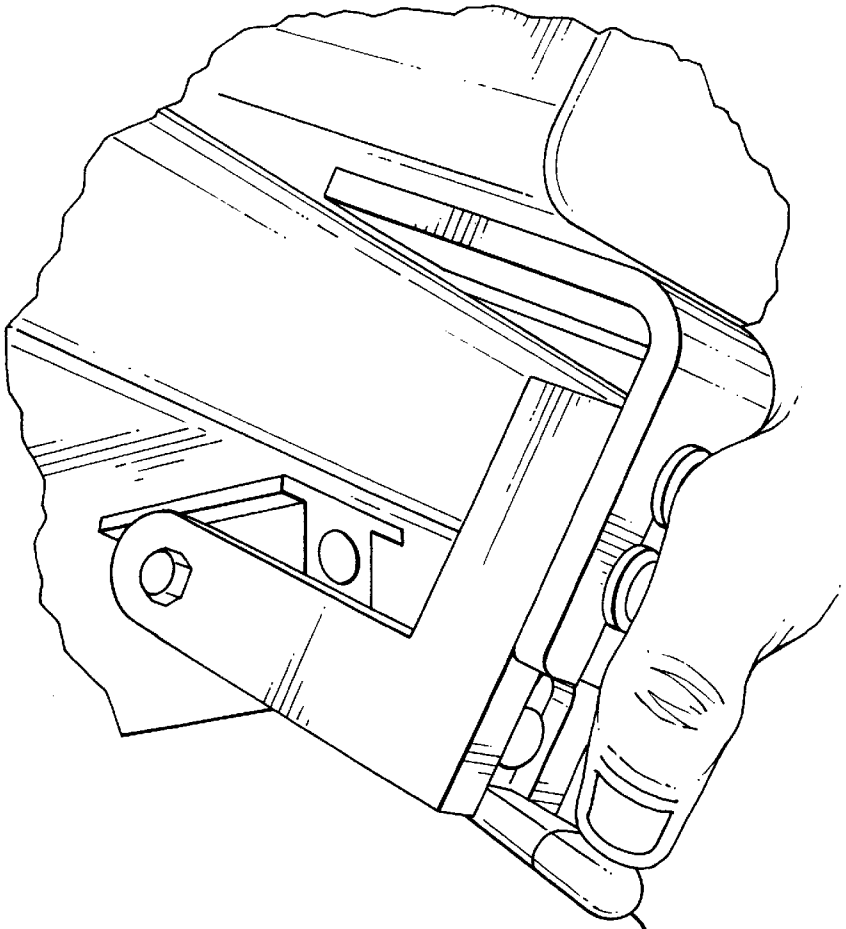
FIG. 8 is similar to FIG. 7, but from a slightly different angle.

FIG. 8 is similar to FIG. 7, but from a slightly different angle.

Figure 9:
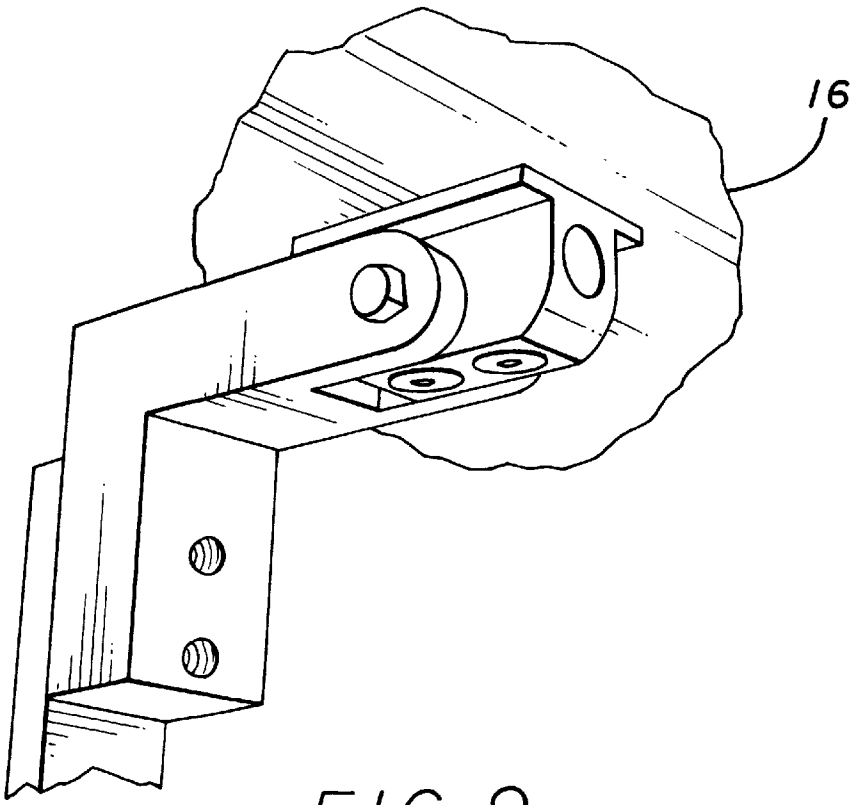
FIG. 9 shows the pelvic support pad rotated all the way downwardly, having been rotated to a position that is approximately 180 degrees from the locked position of FIG. 7.

FIG. 9 shows the pelvic support pad 26 rotated all the way downwardly, having been rotated to a position that is approximately 180 degrees from the locked position of FIG. 7.

Figure 10:
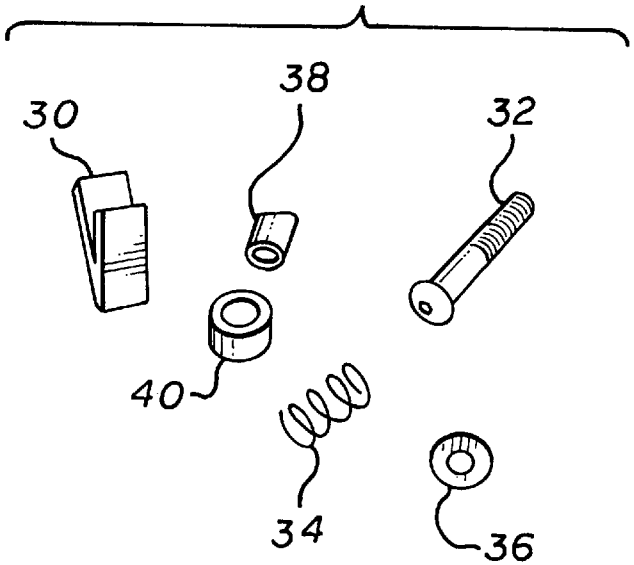
FIG. 10 illustrates some individual components of the system, including the disengagement lever, the sliding bolt, a compression spring, a washer, the engagement head that extends from the sliding bolt and a receptor for receiving the engagement head.

FIG. 10 illustrates some individual components of the system, including the disengagement lever 30, the sliding bolt 32 with a bolthead 33, a compression spring 34, a washer 36, the engagement head 38 that extends from the sliding bolt 32 and a receptor 40 for receiving the engagement head 38.

Figure 11:
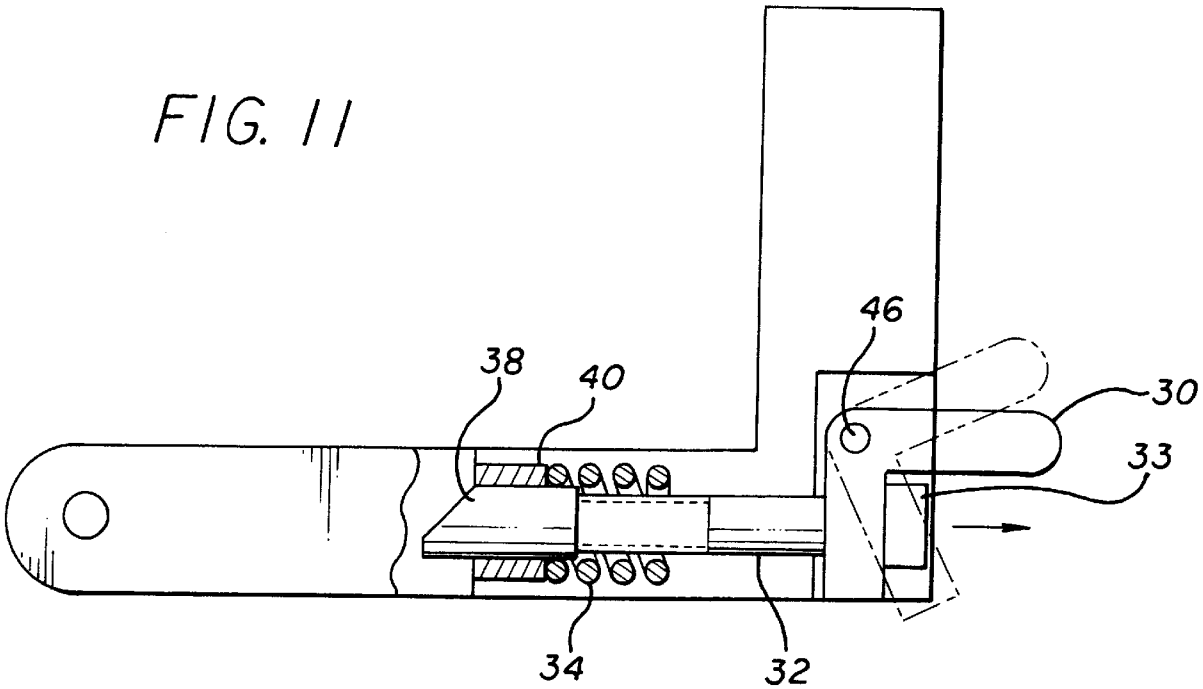
FIG. 11 is a sectional view of the pelvic support mechanism of FIG. 7, illustrating that the forked head of the pivotally mounted lever abuts the head of the sliding bolt

FIG. 11 is a sectional view of the pelvic support mechanism of FIG. 7, illustrating that the pronged engagement portion 42 of the pivotally mounted lever 30 abuts the head of the sliding bolt 32. As the lever is rotated, the head of the bolt is pulled outwardly. The engagement head 38 disengages from the receptor 40, and the pelvic support mechanism is unlocked.

Figure 12:
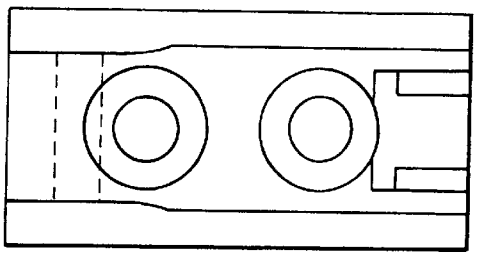
FIG. 12 is an additional sectional view of the pelvic support mechanism.

FIG. 12 is an additional sectional view of the pelvic support mechanism.

Figure 13:
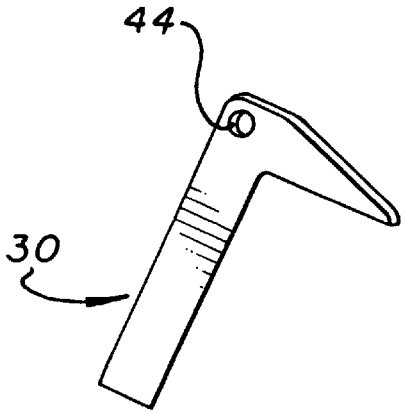
FIG. 13 is a detail view of the disengagement lever, illustrating the aperture through which a pin extends to pivotally mount the lever as illustrated in FIG. 11.
Figure 16C:
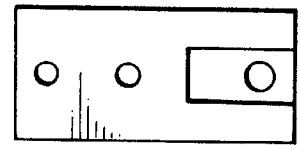
FIG. 16–17 are further views of components of one embodiment of the present invention, and include exemplary, nonlimiting dimensions.
Figure 16B:
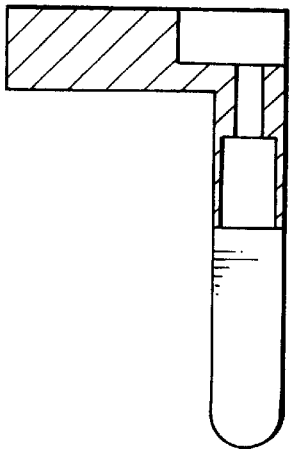
Figure 16D:
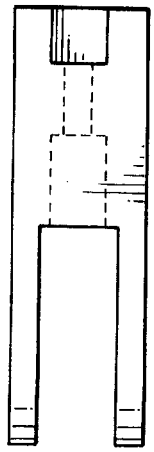
Figure 16A:
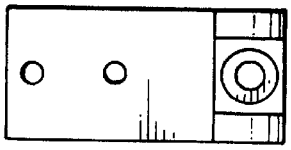
Figure 17B:
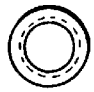
Figure 17A:
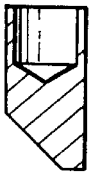

FIG. 13 is a detail view of the disengagement lever 30, illustrating the aperture 44 through which a pin 46 (FIG. 11) extends to pivotally mount the lever as illustrated in FIG. 11.

Figure 14:
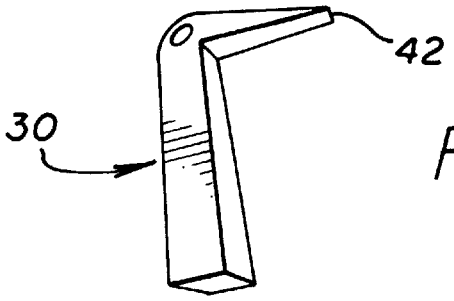
FIG. 14 is another detail view of the disengagement lever, illustrating the pronged engagement lever.

FIG. 14 is another detail view of the disengagement lever 30, illustrating the pronged, forked engagement portion 42.

Figure 15:
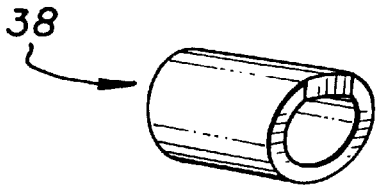
FIG. 15 is a detail view of the engagement head that extends from the end of the sliding bolt, as illustrated in FIG. 11.

FIG. 15 is a detail view of the engagement head 38 that extends from the end of the sliding bolt 32, as illustrated in FIG. 11.

Considering now another aspect of the invention, the pelvic support described above may be used in combination with a convenient trunk support apparatus, as described in U.S. Provisional Patent Application 60/129,978, which was filed on Apr. 19, 1999, and in a patent application entitled, "Hinge Mechanism For A Trunk Support Apparatus," which is being filed concurrently herewith. FIG. 1 illustrates such a hinge mechanism in combination with a pelvic support as described above.

Generally speaking, a pelvic support mechanism according to this aspect of the invention includes a back bracket, a front bracket, and a hinge piece that extends from the back bracket toward the front bracket. The hinge piece has a top and a bottom, with the bottom including an elongated open channel defined by first and second walls. A locking member is rotatably mounted on the front bracket. The locking member has an angled lever and an elongated locking head that is configured to fit within the open channel of the hinge piece. The lever extends downwardly from the front bracket, and the locking head extends forwardly. The locking mechanism has a first, locked mode in which the locking head is situated within the open channel and in between the first and second walls, and a second, unlocked mode in which the locking head is situated outside of the open channel. The locking mechanism may also include a compression spring mounted within the hinge piece and adjacent to the locking member, to maintain the locking head in the open channel when the locking mechanism is in the first, locked mode.

Particular embodiments of the trunk support mechanism may incorporate various features. For example, the locking head may be at least ½ inch long. The front and rear brackets and the hinge piece may be ½" or less thick in order to limit the bulk of the support. In the locked position, the entire length of locking head may be engaged in the locking channel. The lever of the locking member may extend at an angle of between about 10 degrees and 60 degrees, and preferably from between about 20 degrees and 45 degrees, downwardly from the front bracket. This angled lever provides a convenient means of engaging the locking member to unlock the hinge mechanism. The lever and hinge member are typically metal, and portions of the mechanism may be made from steel for particular strength and durability. The hinge piece may be separate from but attached to the front bracket, or it may be unitary with the front bracket. The trunk support may be one component in a convenient system for releasably retaining a person in the wheelchair.

Further details of such a trunk support apparatus are described in U.S. Provisional Patent Application 60/129,978, which was filed on Apr. 19, 1999, and in a patent application entitled "Hinge Mechanism For A Trunk Support Apparatus," which is being filed concurrently herewith.

In accordance with one embodiment of the invention, a wheelchair seat includes a convenient trunk support mechanism as described above, and a pelvic support mechanism as illustrated in the drawings and described above. This combination of features provides a convenient system for securing a patient within the wheelchair, with simplified locking and unlocking of the pelvic and side support mechanisms.

It should be understood that the foregoing merely describes a presently preferred embodiment of the present invention. Various changes and amendments may be made within the scope of the invention. Consequently, the invention is not limited to what is disclosed in the specification and shown in the drawings.

What is claimed is:

1. A system for securing a patient within a wheelchair comprising:

a wheelchair seat;

a trunk support mechanism mounted to said wheelchair seat having:

a front bracket;

a hinge piece extending from a back bracket toward the front bracket, the hinge piece having a top and a bottom, said bottom including an elongated open channel defined by first and second walls;

a locking member rotatably mounted on said front bracket, said locking member having a lever and an elongated locking head that is configured to fit within said open channel of said hinge piece, said lever extending downwardly from said front bracket, said locking head extending forwardly;

wherein the locking mechanism has a first, locked mode in which the locking head is situated within the open channel and in between said first and second walls, and a second, unlocked mode in which the locking head is situated outside of the open channel;

said locking mechanism further comprising a compression spring mounted within said hinge piece and adjacent to said locking member, to maintain said locking head in said open channel when the locking mechanism is in the first, locked mode; and a releasable pelvic support mechanism mounted to said wheelchair seat having:

a bracket comprising a generally "L"-shaped, pivoting portion and a stationary portion that is hingedly attached to said "L"-shaped portion;

said pelvic support mechanism having a padded pelvic support mounted on said "L"-shaped, pivoting portion, said stationary portion being mounted onto said wheelchair seat;

a release lever that is pivotally mounted on said "L"-shaped portion of said bracket;

a sliding bolt that is mounted within said "L"-shaped portion of said bracket and which is interconnected with said release lever;

a compression spring that is mounted in said "L"-shaped portion of said bracket and that is in contact with said sliding bolt;

an opening in said stationary portion of said bracket for receiving the sliding bolt;

wherein the releasable pelvic mechanism has a locked mode in which the sliding bolt is engaged with the opening in the pivoting portion of the bracket, thereby preventing the pelvic support from pivoting, and an unlocked mode in which the sliding bolt is not engaged with the opening in the pivoting portion of the bracket, thereby permitting the pelvic support to pivot.

2. A pelvic support mechanism for a wheelchair seat, the pelvic support mechanism comprising:

a bracket comprising a generally "L"-shaped, pivoting portion and a stationary portion that is hingedly attached to said "L"-shaped portion;

said pelvic support mechanism having a padded pelvic support mounted on said "L"-shaped, pivoting portion, said stationary portion adapted to be mounted onto said wheelchair seat;

a release lever that is pivotally mounted on said "L"-shaped portion of said bracket;

a sliding bolt that is mounted within said "L"-shaped portion of said bracket and which is interconnected with said release lever;

a compression spring that is mounted in said "L"-shaped portion of said bracket and that is in contact with said sliding bolt;

an opening in said stationary portion of said bracket for receiving the sliding bolt;

wherein the releasable pelvic mechanism has a locked mode in which the sliding bolt is engaged with the opening in the pivoting portion of the bracket, thereby preventing the pelvic support from pivoting, and an unlocked mode in which the sliding bolt is not engaged with the opening in the pivoting portion of the bracket, thereby permitting the pelvic support to pivot.

3. A pelvic support mechanism for a wheelchair seat as defined in claim 2, wherein said sliding bolt has an angled tip.

4. A pelvic support mechanism for a wheelchair seat as defined in claim 2, wherein said lever is substantially "L"-shaped, with a thumb engagement portion and a pronged portion having a slot, said bolt engaging with the slot.

* * * * *